US005160268A

United States Patent [19]

Hakamian

[11] Patent Number: 5,160,268

[45] Date of Patent: Nov. 3, 1992

[54] FLOATING STACKABLE CONNECTOR

[75] Inventor: Mohammad Hakamian, San Diego, Calif.

[73] Assignee: Teledyne Kinetics, San Diego, Calif.

[21] Appl. No.: 786,053

[22] Filed: Oct. 31, 1991

[51] Int. Cl.[5] ..... H01R 9/09

[52] U.S. Cl. ..... 439/66; 439/74; 439/248; 439/591

[58] Field of Search ..... 439/66, 74, 76, 246–248, 439/591

[56] References Cited

U.S. PATENT DOCUMENTS

| | | | |
|---|---|---|---|
| 3,551,750 | 12/1970 | Sterling | 317/101 |
| 3,673,545 | 6/1972 | Rundle | 439/248 |
| 3,905,666 | 9/1975 | Grimm et al. | 439/66 |
| 4,029,375 | 6/1977 | Gabrielian | 439/66 |
| 4,636,018 | 1/1987 | Stillie | 439/66 |

*Primary Examiner*—Paula A. Bradley
*Attorney, Agent, or Firm*—Nydegger & Associates

[57] ABSTRACT

A floating stackable connector for connecting the conductors of stacked substrates such as printed circuit boards is provided. The connector includes an elongated insulator block having a plurality of parallel spaced spring contacts mounted in channels formed on the insulator block. The connector also includes a mounting means for mounting the connector to one of the substrates such that it may move or float between the substrates. In an illustrative embodiment the mounting means includes threaded inserts mounted within counterbored openings on either side of the insulator block adapted to be attached to threaded fasteners placed through one of the substrates.

13 Claims, 2 Drawing Sheets

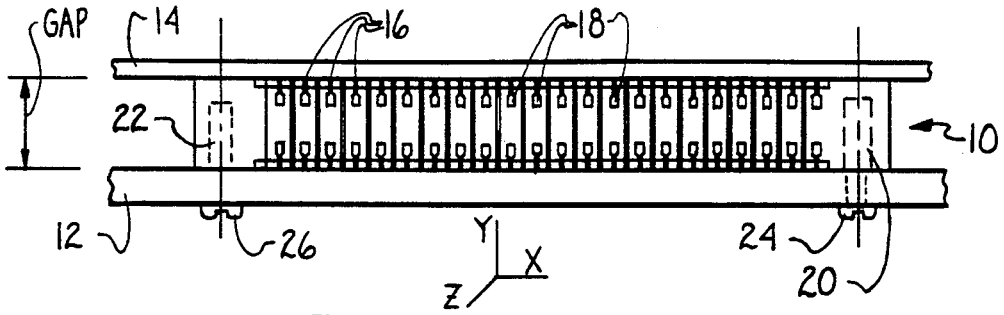
Fig. 1 (PRIOR ART)
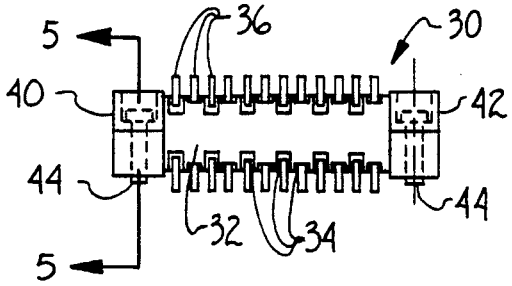
Fig. 2
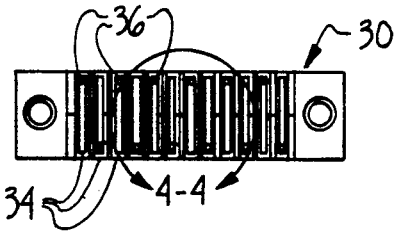
Fig. 3
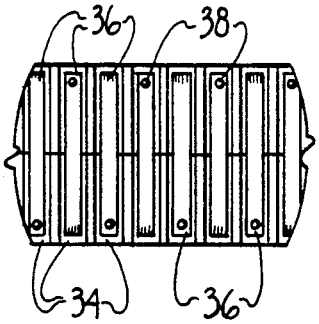
Fig. 4
Fig. 5A
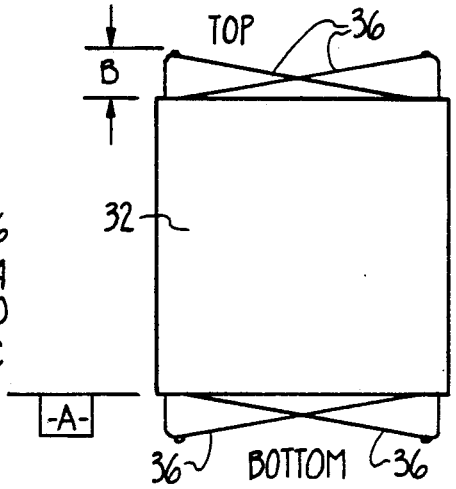
Fig. 5
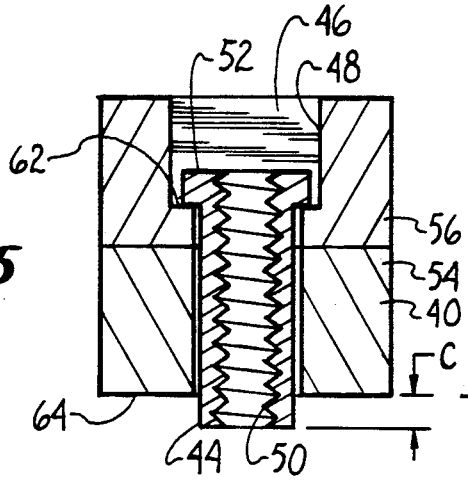

Fig. 6
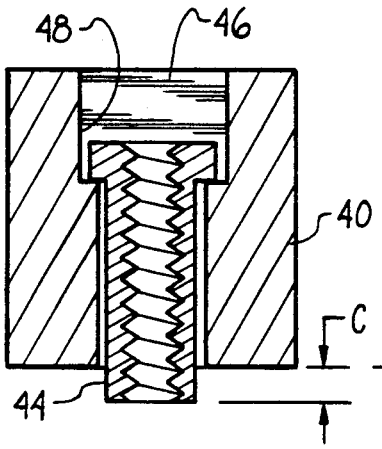
Fig. 6A
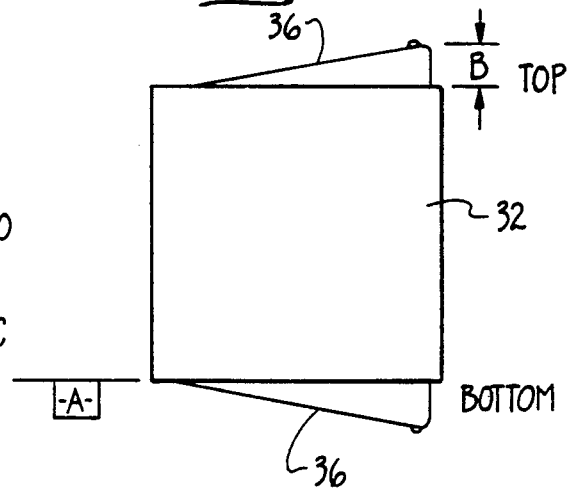
FULLY OPEN POSITION
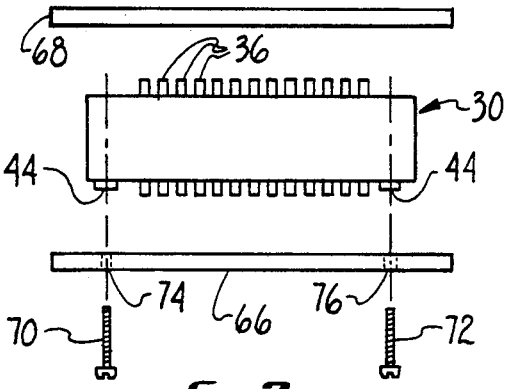
Fig. 7
SUBSTRATE 1 ATTACHED
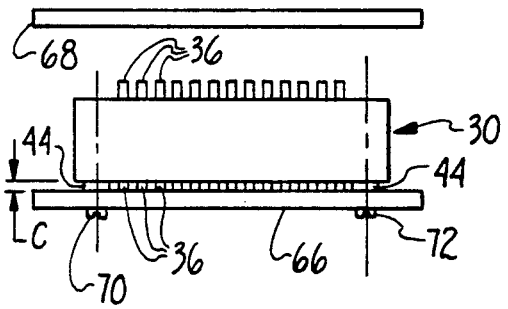
Fig. 8
SUBSTRATE 2 ATTACHED
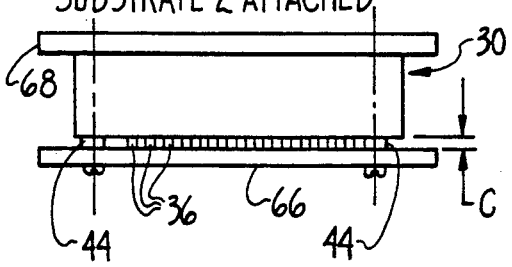
Fig. 9
FULLY CLOSED POSITION
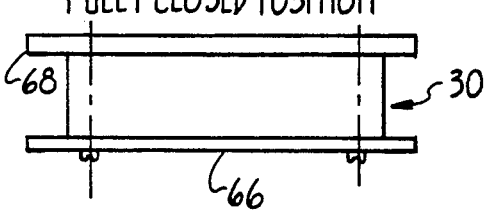
Fig. 10

FLOATING STACKABLE CONNECTOR

FIELD OF THE INVENTION

This invention relates generally to electrical connectors and more particularly to connectors for providing electrical connection between the individual conductors of stacked substrates such as printed circuit boards.

BACKGROUND OF THE INVENTION

In the electronics industry circuit miniaturization and more compact packaging arrangements have led to the development of different types of connectors for electrically connecting substrates. In general such connectors may be utilized to provide a detachable electrical connection between adjacent circuit boards. As an example, stacked connectors provide a connection for circuit boards that are stacked relative to one another.

Such connectors generally utilize spring contact elements to bridge the gap between the stacked substrates and electrically connect the individual conductors formed on the peripheral edges of each substrate. The spring contact elements may be molded to the connector and are typically mounted in channels formed on the connector. As an example, the connector may be clamped between the substrates by fixedly attaching the connector to both of the substrates using threaded fasteners or the like. U.S. Pat. No. 4,057,311 to Evans and U.S. Pat. No. 3,551,750 to Sterling disclose representative prior art connectors and mounting arrangements for stacked substrates.

Another mounting arrangement for stacked substrates uses surface compression generated between the substrates to sandwich the connector therebetween. In this case the connector may be attached to one of the substrates and is compressed between the substrates. The substrates may be mounted to a separate holder or frame that holds the substrates in a parallel spaced alignment.

With any connector it is of primary importance to maintain electrical contact between the individual contacts of the connector and the individual conductors of the stacked substrates. Since with most stacking arrangements the connector is typically fixedly attached to one of the substrates, any variations between the spacing of the substrates must be bridged by deflection of the spring contacts. Such variations in the spacing between substrates may occur for example, due to accumulated tolerances, board deflections or variations in board thickness.

A spring contact of a connector may not contain enough travel, however, to maintain electrical contact if the spacing at any point between the stacked substrates is too large. Moreover, with conventional connectors it may be difficult to form the spring contacts with a large amount of deflection to accommodate an accumulation of tolerances.

The present invention is directed to an electrical connector in which the connector is free to move or "float" relative to the separate stacked substrates. This in effect maximizes the effective contact height on at least one side of the connector.

It is therefore an object of the present invention to provide an electrical connector for stacked substrates that is free to move or float between the substrates to enable increased contact efficiency. It is a further object of the present invention to provide an electrical connector that maximizes the effective contact height of the spring contacts on at least one side of the connector to compensate for large or irregular spacing between stacked substrates. It is yet another object of the present invention to provide an electrical connector that is simple to use, relatively easy to manufacture, and comparatively cost-effective.

SUMMARY OF THE INVENTION

In accordance with the present invention, a floating electrical connector for connecting stacked substrates is provided. The floating connector simply stated, comprises, an elongated insulator block having a plurality of parallel spaced spring contacts molded to the insulator block and disposed within channels formed thereon, and mounting means for mounting the insulator block to one of the substrates such that the insulator block may move or float between the stacked substrates.

In an illustrative embodiment of the invention the mounting means includes threaded inserts that are movably mounted within counterbored openings formed on the ends of the insulator block. The threaded inserts extend a distance past a side of the insulator block but are free to slide within the counterbored openings through a preselected range of motion. The insulator block is attached to one of the substrates using threaded fasteners placed through the substrate and attached to the inserts. Since the inserts can slide or move within the insulator block, the connector is free to float between the substrates.

In use the insulator block is mounted on the inserts to one of the substrates with the spring contacts on one side of the insulator contacting the substrate. The second substrate can then be stacked at a spaced distance relative to the substrate to contact the spring contacts on the opposite side of the insulator block. Surface compression from the second substrate allows the connector to float downward on the inserts maximizing the effective contact height of the spring contacts in contact with the second substrate.

Other objects, advantages, and capabilities of the present invention will become more apparent as the description proceeds.

BRIEF DESCRIPTION OF THE DRAWINGS

FIG. 1 is a side elevation view of a prior art connector for connecting stacked substrates;

FIG. 2 is a side elevation view of a floating stackable connector formed in accordance with the invention;

FIG. 3 is a bottom view of FIG. 2;

FIG. 4 is an enlarged portion of the connector taken along section line 4—4 of FIG. 3;

FIG. 5 is a section taken along section line 5—5 of FIG. 2;

FIG. 5A is a partially schematic side elevation view of the connector showing deflection of the spring contacts;

FIG. 6 is a cross-section equivalent to section 5—5 of FIG. 2 in an alternate embodiment connector;

FIG. 6A is a partially schematic side elevation view of the alternate embodiment connector;

FIG. 7 is a schematic diagram of a connector constructed in accordance with the invention shown in a fully open unconnected position;

FIG. 8 is a schematic diagram of a connector constructed in accordance with the invention shown attached to a first substrate;

FIG. 9 is a schematic diagram of a connector constructed in accordance with the invention shown as able to move or float between the first substrate and a second substrate; and FIG. 10 is a schematic diagram of a connector constructed in accordance with the invention shown fully pressed by surface compression from the second substrate between the first and second substrates.

DESCRIPTION OF THE PREFERRED EMBODIMENTS

Referring now to FIG. 1, a prior art arrangement for connecting stacked substrates is shown. In FIG. 1 a prior art connector 10 is sandwiched between two substrates 12, 14 for connecting electrical components on the substrates 12, 14. As used herein, the term substrate refers generally to any substantially planar support having electrical components mounted thereon, such as a printed circuit board having individual conductors formed along an outer peripheral edge.

The prior art connector !0 is an elongated generally rectangular shaped structure that includes a plurality of parallel spaced spring contacts 16. The ends of the spring contacts 16 are mounted in a plurality of parallel spaced channels 18. The spring contacts 16 make electrical contact with the individual conductors on the substrates 12, 14.

For mounting the prior art connector 10 between the substrates 12, 14, threaded inserts 20, 22 are attached to either end of the connector 10. Threaded fasteners such as flat-head screws 24, 26 are placed through the first substrate 12 and threaded into the inserts 20, 22. The second substrate 14 is then stacked above the first substrate 12 on a separate mounting means (not shown) such as a slotted frame. Surface compression from the second substrate depresses the spring contacts into engagement with the conductors on the second substrate 14.

A problem with such a prior art mounting arrangement is that the size of a gap between the substrates 12, 14 may vary. Since the connector 10 is fixed to the first substrate 12 the spring contacts 16 on one side of the connector 10 must have enough travel or deflection to contact the conductors of the second substrate 14. This gap dimension may vary as a result of accumulated tolerances of the substrate 12, 14 and their mounting arrangement. As an example the size of the gap may vary by as much as 0.050 inches. Consequently the spring contacts 16 may not contain enough deflection to contact the conductors of the second substrate 14.

The present invention is directed to a connector that effectively increases the contact height of the spring contacts on at least one side of the connector by allowing the connector to move or float between stacked substrates.

Referring now to FIG. 2 a connector formed in accordance with the invention is shown and generally designated as 30. The connector 30 broadly stated, includes an insulator block 32, a plurality of spring contacts 36 mounted to the insulator block 32, and floating mounting means 44 for the insulator block formed at each end of the insulator block 32.

The insulator block 32 of the connector 30 is an elongated member that is generally rectangular in cross-section formed about a longitudinal axis. The insulator block 32 has a plurality of parallel spaced channels 34 formed on opposite parallel surfaces generally transverse to the longitudinal axis. The channels 34 are generally u-shaped in cross-section. The connector 30 may be of a one or two piece molded construction formed of an insulative material such as a thermoplastic. A two piece connector having a split as shown in FIG. 2 is one method of manufacture.

A plurality of spring contacts 36 are mounted to the insulator block 32. The spring contacts 36 are thin and resilient conductive metal strips which are preferably molded directly into the insulator block. The ends of the spring contacts 36 may be bent at about a 90° angle and are disposed within the channels 34 as shown in FIG. 4.

Additionally, as shown in FIGS. 5A and 6A, the spring contacts 36 extend past the sides of the insulator block 32. In FIGS. 5A and 6A the approximate peripheral shape of the ends of the spring contacts 36 is shown. As shown in FIGS. 5A and 6A the spring contacts 36 are formed to deflect within the channels 34 through a distance of B. Additionally as shown in FIG. 4, the spring contacts 36 may be formed with a raised generally circular, contact portion 38 for contacting the conductors of the substrates. Contact portion 38 is provided to improve the point of contact of the spring contacts 36 with the conductors of the substrate (not shown).

The elongated insulator block 32 also includes a first end 40 and a second end 42 wherein threaded inserts 44 are mounted as a float mounting means. The threaded inserts 44 are free to slide or move within the insulator block 32. The construction of the ends 40, 42 of the insulator block 32 and an insert 44 is clearly shown in FIGS. 5 and 6.

With reference to FIG. 5 each end 40 or 42 of the insulator block 32 is formed with a counterbored opening 46 for the threaded insert 44. Counterbored opening 46 is formed with an inside diameter large enough to permit the insert 44 to move up and down (i.e. in the y-direction, FIG. 1) within the ends 40, 42 of the insulator block 40. Moreover, the counterbored opening 44 is formed with an increased diameter counterbored section 48. This may be accomplished with a two piece 54, 56 construction as shown in FIG. 5 or with a one piece 40 construction as shown in FIG. 6. Alternately, as would be apparent to one skilled in the art, other methods of construction, would also be possible. As will hereinafter be explained the counterbored surface and a shoulder 52 formed on the insert function as a stop means for limiting movement of the insert 44 within the opening 46.

The insert 44 may be generally cylindrical in shape and is formed with an internal thread 50. Alternately the insert 44 may be hexagonal or square in cross-section to keep from rotating within the opening 46. Additionally the insert 44 includes the shoulder portion 52. Movement of the insert 44 within the opening 46 is limited by the shoulder 52 of the insert 44 contacting the counterbored surface 62 formed at the intersection increased diameter of counterbored section 48 and opening 46. The insert 44 may be sized such that with shoulder 52 contacting surface 62 the insert 44 extends past a lower surface 64 of the insulator block 32 by a distance of C. Additionally, the counterbore section 48 may be sized to allow up and down movement of the insert 44 within the counterbored opening 46 to a distance C. As will hereinafter, be more fully explained this mounting of the inserts 44 allows the connector 30 to move or float between stacked substrates such that an effective contact height of the spring contacts 36 of the connector 30 is increased from a distance of B (FIG. 5A) to a distance of B+C. The alternate embodiment shown in FIG. 6 and 6A provides the same result.

Referring now to FIGS. 7–10 the mounting of the connector 30 between a first substrate 66 and a second substrate 68 is shown. The substrates 66, 68 are adapted to be stack mounted generally parallel to one another on an independent frame or other stack mounting means (not shown). The frame is adapted to hold the substrates 66, 68 in a fixed spaced relationship.

As shown in FIG. 7, for attaching the connector 30 to the first substrate 66, screws 70, 72 are placed through holes 74, 76 in the first substrate 66. As shown in FIG. 8, the screws 70, 72 are then threaded into the inserts 44 and the spring contacts 36 on a first side of the connector 30 contact the conductors (not shown) of the first substrate 66. In this position spring force from the spring contact 36 maintains separation of the insulator block 30 and first substrate 66 by a distance of C. Next as shown in FIG. 9 the second substrate 68, can be attached to an independent frame in spaced alignment with the first substrate, 66 and in contact with the spring contacts on a second side of the connector 30. If provided by the mounting arrangement and as shown in FIG. 10, the second substrate, 66, can be further pressed (i.e. surface compression) against the connector and the inserts 44 may move upward within the connector 30 by a distance of up to C. This is denoted as the fully closed position. The connector 30 is thus free to float between the substrates 66, 68 by a distance of up to C. This effectively increases the contact height of the spring contacts 36 on one side of the conductor block with the second substrate 68 to a distance of C plus the contact deflection distance B (FIG. 5A). The effective contact height is therefore B+C. With this arrangement the effective contact height may be in the range of about 0.090 inches. This can be nearly double the contact height of spring contacts formed on prior art connectors.

This arrangement helps to compensate for spacing variations in the gap between the fixed mounting of the substrates 66, 68. Such a gap distance may vary as previously explained due to accumulated tolerances. Thus the connector of the invention provides a floating mounting means for floating the connector between substrates. A float mounting means other than the threaded insert and counterbored opening may also be suitable in this application as long as the connector is free to float between the stacked substrates.

While the particular device as herein shown and disclosed in detail is fully capable of obtaining the objects and providing the advantages herein before stated, it is to be understood that it is merely illustrative of the presently preferred embodiments of the invention and that no limitations are intended to the details of the construction or design herein shown other than as defined in the appended claims.

I claim:

1. An electrical connector for connecting electrical components of a first substrate with electrical components of a second substrate, comprising:

an elongated insulator block having two generally parallel sides;

a plurality of spring contacts mounted to the insulator block each having a contact end extending past a side of the insulator block;

float mounting means for mounting the insulator block on the first substrate with the contact ends on a first side of the insulator block contacting the first substrate and with the contact ends on a second side of the insulator block contacting the second substrate and with the insulator block free to move between the substrates said float mounting means comprising an insert movably mounted within an opening in the insulator block for attachment to a fastener attached to one of the substrates.

2. The electrical connector as claimed in claim 1 and wherein:

the insert is threaded for attachment to threaded fasteners and is formed with a shoulder for contacting a counterbored surface in the opening of the insulator block.

3. The electrical connector as claimed in claim 2 and wherein:

a pair of inserts are movably mounted within a pair of openings in the insulator block.

4. The electrical connector as claimed in claim 3 and wherein:

the openings are located on either end of the insulator block.

5. An electrical connector for connecting individual conductors of a first substrate with conductors of a second substrate comprising:

a generally rectangular elongated insulator block having a plurality of channels formed on opposite parallel sides;

a plurality of spring contacts molded to the insulator block and disposed within the channels and having contact ends extending past the sides of the insulator block; and mounting means including a pair of threaded inserts mounted in openings on either end of the insulator block with the inserts free to move within the openings and adapted to be attached to fasteners through the first substrate whereby the insulator block may be contacted by surface compression from the second substrate and move between the substrates to increase an effective contact height of the spring contacts on one side of the insulator block.

6. The electrical connector as claimed in claim 5 and wherein:

the insulator block is formed in two mating halves.

7. The electrical connector as claimed in claim 5 and wherein:

the second substrate provides surface compression for fully closing the spring contacts into the channels.

8. The electrical connector as claimed in claim 5 and further comprising:

stop means for limiting movement of the inserts within the openings.

9. The electrical connector as claimed in claim 8 and wherein:

the openings in the insulator block are counterbored and the insert pins have a shoulder for limiting movement of the inserts.

10. The electrical connector as claimed in claim 8 and wherein:

the openings in the insulator block are formed with grooves for contacting a shoulder portion of the inserts.

11. An electrical connector for connecting electrical components of a first substrate with electrical components of a second substrate comprising:

an elongated insulator block having two generally parallel sides, a first end having an opening therethrough, and a second end having an opening therethrough with the openings generally parallel to one another and perpendicular to the sides;

a plurality of channels formed in the sides of the insulator block extending transverse to a longitudinal axis of the insulator block;

a plurality of spring contacts molded to the insulator block and disposed within the channels and having contact ends extending past each side of the insulator block;

a pair of threaded inserts movably mounted within the openings on the ends of the insulator block and adapted to be attached to threaded fasteners placed through the first substrate;

whereby the second substrate may contact the spring contacts on one side of the insulator block and the insulator block may move under surface compression from height of the spring contacts on one end is increased.

12. The electrical connector as claimed in claim 11 and wherein:

the threaded inserts are formed with a shoulder portion that contacts a counterbored surface of the openings and the inserts extend past a side of the insulator block by a distance of "C".

13. The electrical connector as claimed in claim 12 and wherein:

the inserts may move within the openings by a distance of at least "C" whereby the effective contact height of the spring contacts on one end is increased by "C".

* * * * *